US007614124B2

(12) United States Patent
Keene et al.

(10) Patent No.: US 7,614,124 B2
(45) Date of Patent: Nov. 10, 2009

(54) BUCKLE ASSEMBLY HAVING SINGLE RELEASE FOR MULTIPLE BELT CONNECTORS

(75) Inventors: Allen R. Keene, Scottsdale, AZ (US); David Thayer Merrill, Scottsdale, AZ (US)

(73) Assignee: AmSafe, Inc., Phoenix, AZ (US)

( * ) Notice: Subject to any disclaimer, the term of this patent is extended or adjusted under 35 U.S.C. 154(b) by 0 days.

(21) Appl. No.: 11/844,709

(22) Filed: Aug. 24, 2007

(65) Prior Publication Data

US 2008/0172847 A1 Jul. 24, 2008

Related U.S. Application Data

(63) Continuation of application No. 11/148,914, filed on Jun. 9, 2005, now Pat. No. 7,263,750.

(51) Int. Cl.
*A44B 11/25* (2006.01)
*A44B 11/26* (2006.01)

(52) U.S. Cl. ..... 24/638; 24/636; 24/637

(58) Field of Classification Search ..... 24/629–633, 24/636–638, 640, 641, 643, 646
See application file for complete search history.

(56) References Cited

U.S. PATENT DOCUMENTS

| | | | | |
|---|---|---|---|---|
| 2,641,813 | A * | 6/1953 | Loxham | 24/632 |
| 2,803,864 | A | 8/1957 | Bishaf | |
| 2,846,745 | A | 8/1958 | Lathrop | |
| 2,869,200 | A | 1/1959 | Phillips et al. | |
| 2,876,516 | A | 3/1959 | Cummings | |
| 2,893,088 | A | 7/1959 | Harper et al. | |
| 2,901,794 | A | 9/1959 | Prete, Jr. | |
| 3,029,487 | A | 4/1962 | Asai | |
| 3,118,208 | A | 1/1964 | Wexler | |
| 3,179,992 | A | 4/1965 | Murphy, Sr. | |
| 3,218,685 | A | 11/1965 | Atumi | |
| 3,226,791 | A | 1/1966 | Carter | |
| 3,256,576 | A | 6/1966 | Klove, Jr. et al. | |
| 3,289,261 | A | 12/1966 | Davis | |
| 3,312,502 | A | 4/1967 | Coe | |
| 3,369,842 | A | 2/1968 | Adams et al. | |
| 3,451,720 | A * | 6/1969 | Makinen | 297/483 |
| 3,491,414 | A * | 1/1970 | Stoffel | 24/632 |

(Continued)

FOREIGN PATENT DOCUMENTS

| | | |
|---|---|---|
| DE | 4421688 | 12/1995 |

(Continued)

OTHER PUBLICATIONS

International Search Report for Application No. PCT/US2006/022367; Applicant: Amsafe, Inc.; Mailed: Sep. 18, 2006; 6 pgs.

(Continued)

*Primary Examiner*—Robert J Sandy
*Assistant Examiner*—Ruth C Rodriguez
(74) *Attorney, Agent, or Firm*—Perkins Coie LLP

(57) ABSTRACT

A buckle assembly for a vehicle restraint system where the buckle assembly is adapted to receive a plurality of belt connectors, with the belt connectors being simultaneously released upon moving at least one handle to a release position.

27 Claims, 7 Drawing Sheets

U.S. PATENT DOCUMENTS

| | | | | |
|---|---|---|---|---|
| 3,505,711 | A | 4/1970 | Carter | |
| 3,564,672 | A | 2/1971 | McIntyre | |
| 3,639,948 | A * | 2/1972 | Sherman | 24/632 |
| 3,673,645 | A * | 7/1972 | Burleigh | 24/630 |
| 3,760,464 | A | 9/1973 | Higuchi | |
| 3,825,979 | A | 7/1974 | Jakob | |
| 4,239,260 | A | 12/1980 | Hollowell | |
| 4,262,396 | A | 4/1981 | Koike et al. | |
| 4,425,688 | A | 1/1984 | Anthony et al. | |
| 4,457,052 | A | 7/1984 | Hauber | |
| 4,617,705 | A | 10/1986 | Anthony et al. | |
| 4,637,102 | A | 1/1987 | Teder et al. | |
| 4,640,550 | A | 2/1987 | Håkansson | |
| 4,644,618 | A | 2/1987 | Holmberg et al. | |
| 4,646,400 | A | 3/1987 | Tanaka et al. | |
| 4,679,852 | A | 7/1987 | Anthony et al. | |
| 4,685,176 | A * | 8/1987 | Burnside | 24/631 |
| 4,692,970 | A | 9/1987 | Anthony et al. | |
| 4,757,579 | A | 7/1988 | Nishino et al. | |
| 4,790,597 | A | 12/1988 | Bauer et al. | |
| 4,809,409 | A | 3/1989 | Van Riesen et al. | |
| 4,940,254 | A | 7/1990 | Ueno et al. | |
| 5,023,981 | A | 6/1991 | Anthony et al. | |
| 5,038,446 | A | 8/1991 | Anthony et al. | |
| 5,088,160 | A | 2/1992 | Warrick | |
| 5,088,163 | A | 2/1992 | Van Riesen et al. | |
| 5,142,748 | A | 9/1992 | Anthony et al. | |
| 5,182,837 | A | 2/1993 | Anthony et al. | |
| 5,220,713 | A | 6/1993 | Lane, Jr. et al. | |
| 5,267,377 | A | 12/1993 | Gillis et al. | |
| 5,269,051 | A | 12/1993 | McFalls | |
| 5,282,672 | A | 2/1994 | Borlinghaus | |
| 5,283,933 | A | 2/1994 | Wiseman et al. | |
| 5,369,855 | A | 12/1994 | Tokugawa et al. | |
| 5,406,681 | A | 4/1995 | Olson et al. | |
| 5,526,556 | A | 6/1996 | Czank | |
| 5,584,107 | A | 12/1996 | Koyanagi et al. | |
| 5,588,189 | A | 12/1996 | Gorman et al. | |
| 5,606,783 | A | 3/1997 | Gillis et al. | |
| 5,699,594 | A | 12/1997 | Czank et al. | |
| 5,813,097 | A | 9/1998 | Woellert et al. | |
| 5,908,223 | A | 6/1999 | Miller | |
| 5,979,026 | A | 11/1999 | Anthony | |
| 6,056,320 | A | 5/2000 | Khalifa et al. | |
| 6,065,367 | A | 5/2000 | Schroth et al. | |
| 6,309,024 | B1 | 10/2001 | Busch | |
| 6,418,596 | B2 | 7/2002 | Haas et al. | |
| 6,442,807 | B1 | 9/2002 | Adkisson | |
| 6,463,638 | B1 | 10/2002 | Pontaoe | |
| 6,467,849 | B1 | 10/2002 | Deptolla et al. | |
| 6,513,208 | B1 | 2/2003 | Sack et al. | |
| 6,543,101 | B2 | 4/2003 | Sack et al. | |
| 6,588,077 | B2 | 7/2003 | Katsuyama et al. | |
| 6,619,753 | B2 | 9/2003 | Takayama | |
| 6,694,577 | B2 | 2/2004 | Di Perrero | |
| 6,711,790 | B2 | 3/2004 | Pontaoe | |
| 6,719,326 | B2 | 4/2004 | Schroth et al. | |
| 6,763,557 | B2 | 7/2004 | Steiff et al. | |
| 6,796,007 | B1 | 9/2004 | Anscher | |
| 6,868,591 | B2 | 3/2005 | Dingman et al. | |
| 6,871,876 | B2 | 3/2005 | Xu | |
| 6,969,122 | B2 | 11/2005 | Sachs et al. | |
| 7,159,285 | B2 | 1/2007 | Karlsson | |
| 7,263,750 | B2 | 9/2007 | Keene et al. | |
| 2002/0017012 | A1 | 2/2002 | Sack et al. | |
| 2003/0056346 | A1 | 3/2003 | Perrero | |
| 2003/0106193 | A1 | 6/2003 | Pontaoe | |
| 2005/0017567 | A1 | 1/2005 | Sachs et al. | |
| 2007/0257480 | A1 | 11/2007 | Van Druff et al. | |
| 2008/0172847 | A1 | 7/2008 | Keene | |

FOREIGN PATENT DOCUMENTS

| | | |
|---|---|---|
| EP | 0608564 | 8/1994 |
| EP | 1153789 | 11/2001 |
| GB | 1047761 | 11/1966 |

OTHER PUBLICATIONS

U.S. Appl. No. 10/816,013, filed Apr. 1, 2004, Baldwin et al.
Global Seating Systems LLC, "CCOPS," Cobra: Soldier Survival System, 1 page, undated. [Color Copy].

* cited by examiner

BUCKLE ASSEMBLY HAVING SINGLE RELEASE FOR MULTIPLE BELT CONNECTORS

CROSS-REFERENCE TO RELATED APPLICATIONS

This application is a continuation of U.S. patent application Ser. No. 11/148,914 filed Jun. 9, 2005 (now U.S. Pat. No. 7,263,750) entitled BUCKLE ASSEMBLY HAVING SINGLE RELEASE FOR MULTIPLE BELT CONNECTORS, which is incorporated herein by reference in its entirety.

BACKGROUND OF THE INVENTION

1. Field of the Invention

The present invention generally relates to buckle assemblies for use in seat belt or restraint systems that are designed to protect vehicle occupants during a crash event or to hold cargo in place. More particularly, the present invention is directed to a buckle assembly adapted to receive a plurality of independent belt connectors for engagement with a respective plurality of latch mechanisms where the plurality of latch mechanisms may be moved to a release position simultaneously.

2. Discussion of the Prior Art

It has become common place for aircraft, automobiles and other vehicles to have occupant restraint systems. Frequently, there are safety related laws or standards that require certain types of driver and passenger safety systems, depending on the type of vehicle in which the system is to be installed. The systems often utilize seat belts of the well known lap and shoulder belt varieties. Indeed, lap and shoulder belts are commonly combined to provide enhanced ability to restrain movement of an individual.

Typically the lap and shoulder belts are joined to each other or are coupled in some way to the same connector. This permits a single connector to engage a single buckle, facilitating release of the combined belt system via one release handle. However, it often can be awkward for the seat occupant to bring the belt assembly into position to engage the single connector with the buckle. Moreover, in the event of a need to quickly exit the seat and vehicle, such as in the event of an accident or other emergency, occupants can easily get entangled or caught in the combined lap and shoulder belt systems. Also, coupling the lap and shoulder belts to a single connector can impede repair or replacement of a portion of the belt system, such as an individual damaged lap or shoulder belt portion of the system.

Accordingly, it is desirable to provide a seat belt system with a single buckle that can be releasably connected to a plurality of belts, such as both a lap and a shoulder belt. It also is desirable for the plurality of belts to be separately connectable to the buckle, so as to reduce the likelihood of becoming entangled in the belts when releasing them and trying to quickly exit a vehicle, and to permit replacement of separate respective portions of the belt system. In addition, it would be highly advantageous to have the buckle include a handle by which one can affect release of the plurality of separately connected belts to facilitate rapid egress from the vehicle.

Also, in the event that one wishes to combine a lap and shoulder belt into one belt connector and further include a shoulder belt or other multiple belt arrangement into at least a second belt connector, it would be advantageous that such combination could be received in one buckle assembly and that the belt connectors could be released simultaneously by grasping and moving one handle.

Further it is desirable to provide a buckle assembly for a cargo hold down or restraint system that permits rapid release of multiple belt connectors with movement of a single handle.

The present invention addresses shortcomings in buckle assemblies of prior art occupant restraint systems, while providing the above mentioned desirable features.

SUMMARY OF THE INVENTION

The purpose and advantages of the invention will be set forth in and apparent from the description and drawings that follow, as well as will be learned by practice of the invention.

The present invention is generally embodied in a buckle assembly of a vehicle occupant or cargo restraint system. The buckle assembly may be used in any type of vehicle, whether it be an aircraft, spacecraft, truck, automobile, boat or other craft for use in the air, on land or in water. The buckle assembly also may be used with any vehicle occupant, whether the occupant is a vehicle operator or passenger, or for cargo.

Given the advantageous single release capability of the buckle assembly of the present invention, while suitable for use in all types of vehicles, it is ideally suitable for use in vehicles that may require rapid egress, such as aircraft, spacecraft, emergency or military vehicles. Moreover, the simple, reliable and durable structure shown in the lift latch mechanisms of the preferred embodiments, and that may be employed via the present invention, makes it suitable for use in locations where vehicles may encounter adverse environmental factors, such as airborne sand or dirt.

In a first aspect of the invention, the buckle assembly has a buckle base, a plurality of latches coupled to the buckle base with each latch adapted to engage one of a plurality of respective independent belt connectors, and at least one handle coupled to the buckle base and adapted to have at least latching and release positions wherein the plurality of connectors are simultaneously released when the at least one handle is in the release position.

In another aspect of the invention, the buckle base can be configured to have at least three parallel upstanding flanges which are adapted to receive at least two belt connectors, with each belt connector being received between a respective pair of upstanding flanges in a side-by-side orientation within the same plane.

In a further aspect of the invention, the buckle base can be configured to have at least a pair of parallel upstanding flanges which are adapted to receive at least two belt connectors, with each belt connector being received between the pair of upstanding flanges, and the belt connectors being received in a stacked orientation, in spaced, parallel planes.

Thus, the present invention presents a desirable alternative to buckle assemblies used in present vehicle occupant and cargo restraint systems. The invention permits a plurality of belts, such as lap and shoulder belts, or combinations thereof, or cargo restraint to be independently latched into a single buckle assembly, yet simultaneously released by lifting one release handle.

It is to be understood that both the foregoing general description and the following detailed description are exemplary and provided for purposes of explanation only, and are not restrictive of the invention, as claimed. Further features and objects of the present invention will become more fully apparent in the following description of the preferred embodiments and from the appended claims.

BRIEF DESCRIPTION OF THE DRAWINGS

In describing the preferred embodiments, reference is made to the accompanying drawing figures wherein like parts have like reference numerals, and wherein.

Figure 1:
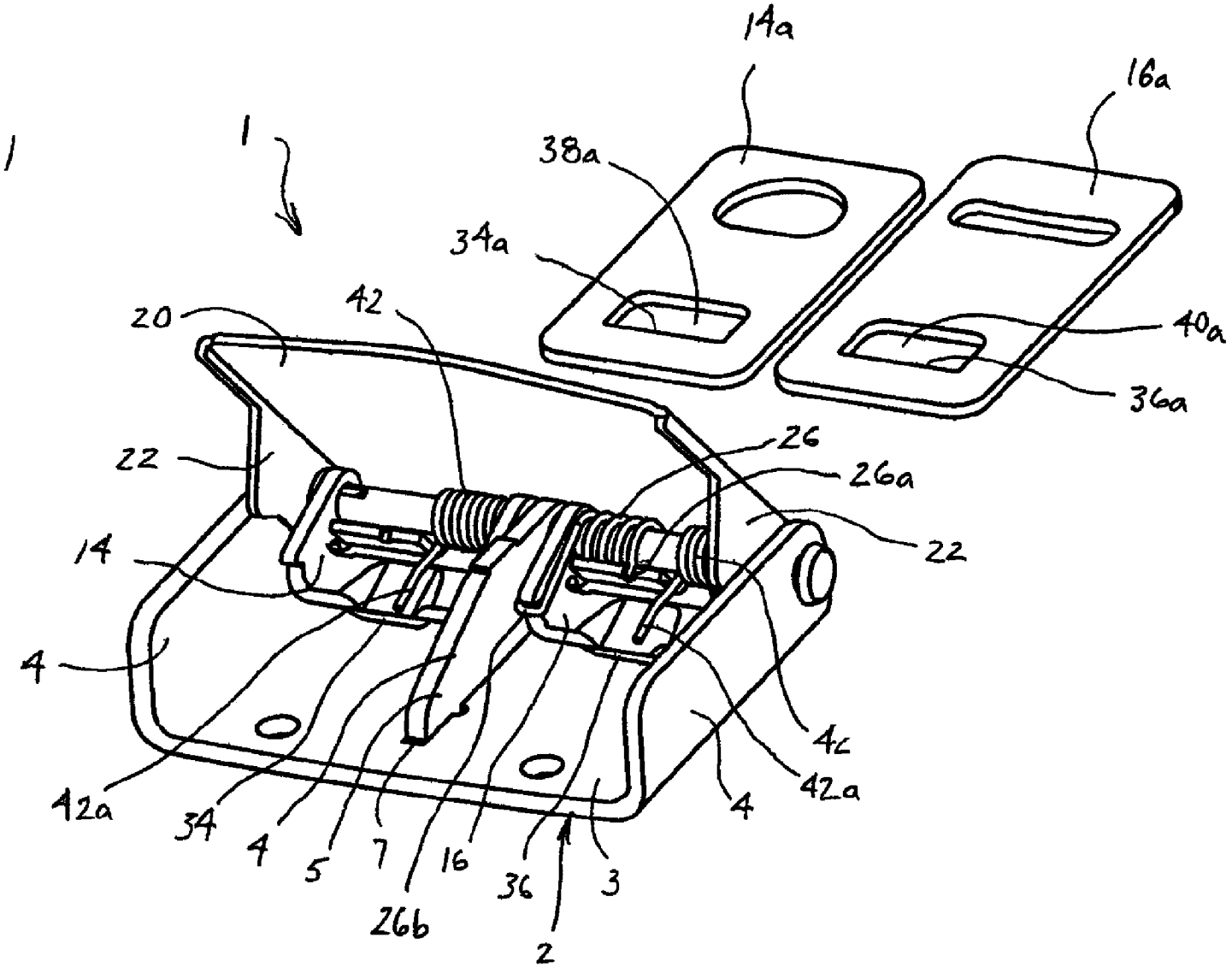
FIG. 1 is a perspective view of a buckle assembly having a pair of latches arranged next to each other, in the same plane, for engaging a respective pair of belt connectors consistent with the present invention.
Figure 2:
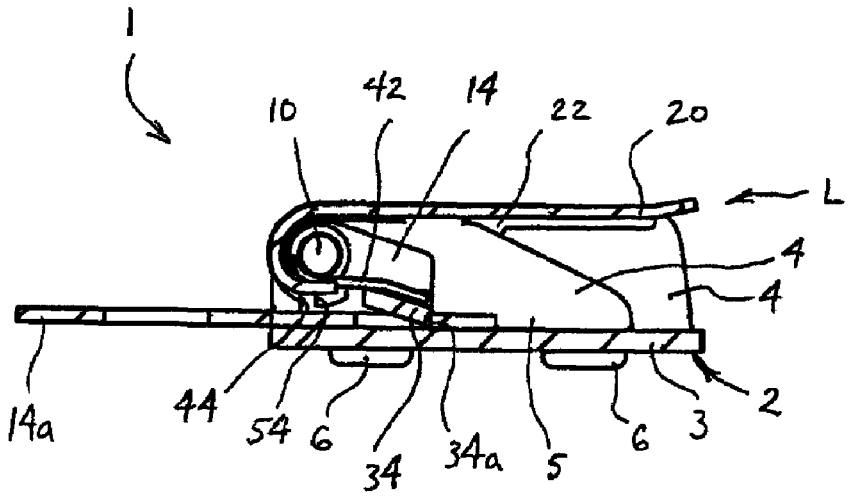
FIG. 2 is a sectioned side view of the buckle assembly of FIG. 1 with the handle in a latching position.
Figure 3:
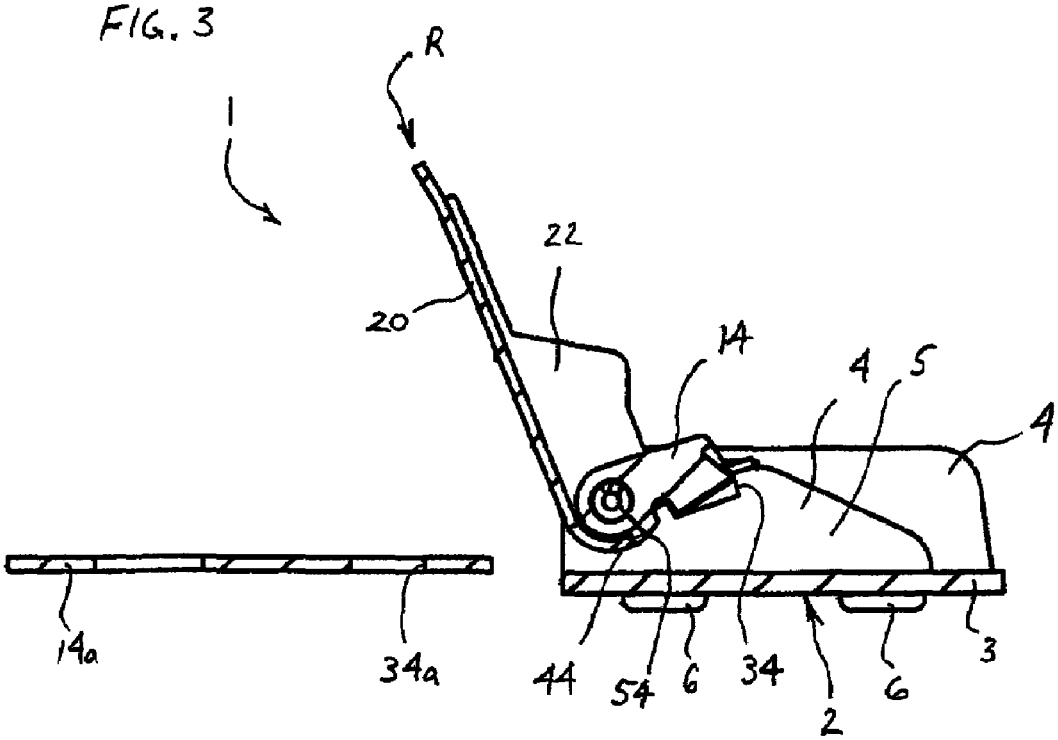
FIG. 3 is a sectioned side view of the buckle assembly of FIG. 1 with the handle in a release position.
Figure 4:
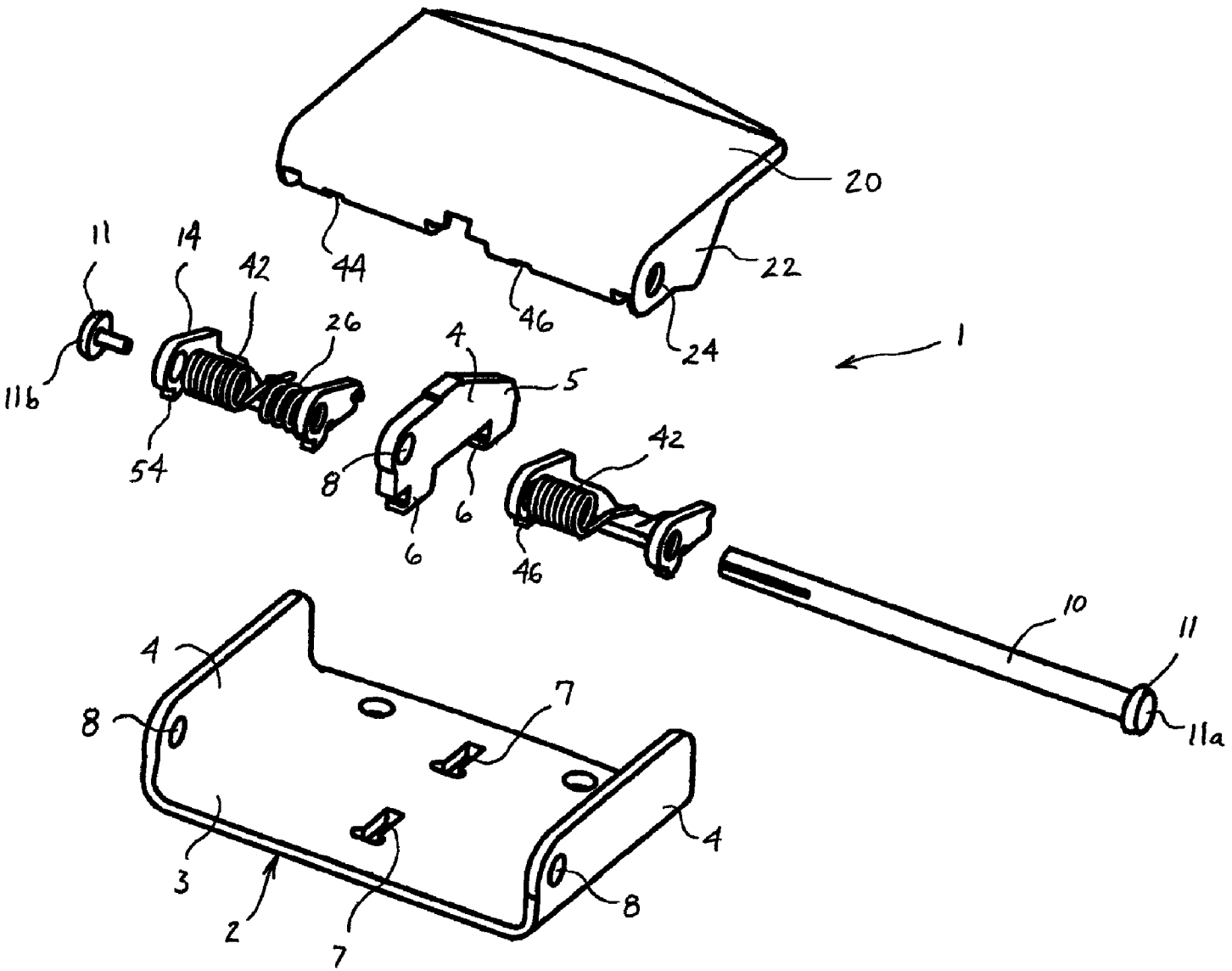
FIG. 4 is an exploded perspective view of the buckle assembly of FIG. 1.

It should be understood that the drawings are not to scale. While considerable mechanical details of a buckle assembly, including other plan and section views of the particular components, have been omitted, such details are considered well within the comprehension of those skilled in the art in light of the present disclosure. It also should be understood that the present invention is not limited to the preferred embodiments illustrated.

DETAILED DESCRIPTION OF THE PREFERRED EMBODIMENTS

Referring generally to FIGS. 1-11 and upon review of this description, it will be appreciated that the buckle assembly of the present invention generally may be embodied within numerous configurations.

Referring to a preferred embodiment in FIGS. 1-4, a buckle assembly 1 has a buckle base 2 having a bottom portion 3 and parallel spaced upstanding flanges 4. Buckle base 2 may be coupled to an occupant or cargo restraint system by direct attachment to a safety belt, cable or other suitable element not shown, and may include belt tensioning or other commonly desirable features. In the preferred embodiment in FIGS. 1-4, upstanding center flange 5 of buckle base 2 is a separate piece having tabs 6 that engage slotted apertures 7 in bottom portion 3. Flanges 4, 5 further have aligned respective apertures 8 therethrough. Aligned apertures 8 receive a pivot axle 10, which in the preferred embodiment is fixed in position by press fit, or by including a knurled engagement with at least one of the flange apertures 8 and use of cap ends 11. Cap ends 11 may be integrally formed as part of pivot axle 10, as shown with cap end 11*a*, or may be a separate piece attached to the end of pivot axle 10, such as by press fitting, threaded engagement or the like, as shown with cap end 11*b* which engages a slotted pivot axle end. It will be appreciated that in the preferred embodiment, pivot axle 10 extending through aperture 8 in separate center flange 5 also serves to lock center flange 5 into position. Alternatively, pivot axle 10 could be configured to be two separate pivot axles, each of which would engage an aperture 8 of an outer flange 4 of buckle base 2, such as by press fit, and they could either each engage aperture 8 in center flange 5, or they otherwise could be connected to each other with one passing through aperture 8 in center flange 5. It also will be appreciated that buckle base 2 could be formed, such as by molding, to include an integral center flange 5, or buckle base 2 could be constructed in a manner in which pivot axle 10 would not pass through an aperture in a center flange.

In the preferred embodiment of FIGS. 1-4, the plurality of latches is a pair of latches 14, 16, pivotally mounted on a pivot axle 10, and spaced side-by-side for receipt of respective belt connectors 14*a*, 16*a*, in the same plane. It is to be understood that, in this context, belt is used to refer to belts, straps, other webbing materials, ropes, cables, and the like. Buckle assembly 1 further includes handle 20 having downward projecting parallel flanges 22. Flanges 22 have aligned apertures 24 for pivotal mounting of handle 20 on pivot axle 10. Handle 20 is biased toward a latching position L by at least one resilient member or biasing element. In the first preferred embodiment, the resilient member is in the form of a single coil spring 26 which engages the handle at a first end 26*a* and engages a latch 16 at a second end 26*b*. While shown as a spring 26, it will be understood that other forms of resilient members, or multiple resilient members could be used. Latches 14, 16 each have a pawl 34, 36 adapted to engage respective forward wall 34*a*, 36*a* of apertures 38*a*, 40*a* in belt connectors 14*a*, 16*a* when handle 20 is in the latching position L. To establish and maintain the engagement of pawls 34, 36, each latch 14, 16 has a second resilient member 42 to bias the respective pawl toward the latched position. In this preferred embodiment, springs 42 engage the pivot axle 10 at a first end (not shown) and engage the latch at a second end 42*a*, although alternative configurations may be used.

To release the belt connectors 14*a*, 16*a*, handle 20 is pivoted to an angled release position R. When handle 20 is pivoted about pivot axle 10 toward the release position R, release edges 44, 46 on handle 20 engage respective release abutments 54, 56 on latches 14, 16, and cause latches 14, 16 to join handle 20 in pivoting about pivot axle 10 to a release position wherein pawls 34, 36 are lifted out of engagement with respective forward walls 34*a*, 36*a* of apertures 38*a*, 40*a* in belt connectors 14*a*, 16*a*. In this release position R, belt connectors 14*a*, 16*a* are simultaneously released and permitted to be withdrawn from buckle assembly 1. It will be understood that alternative configurations for causing movement of the latches upon movement of the handle may be utilized.

Figure 5:
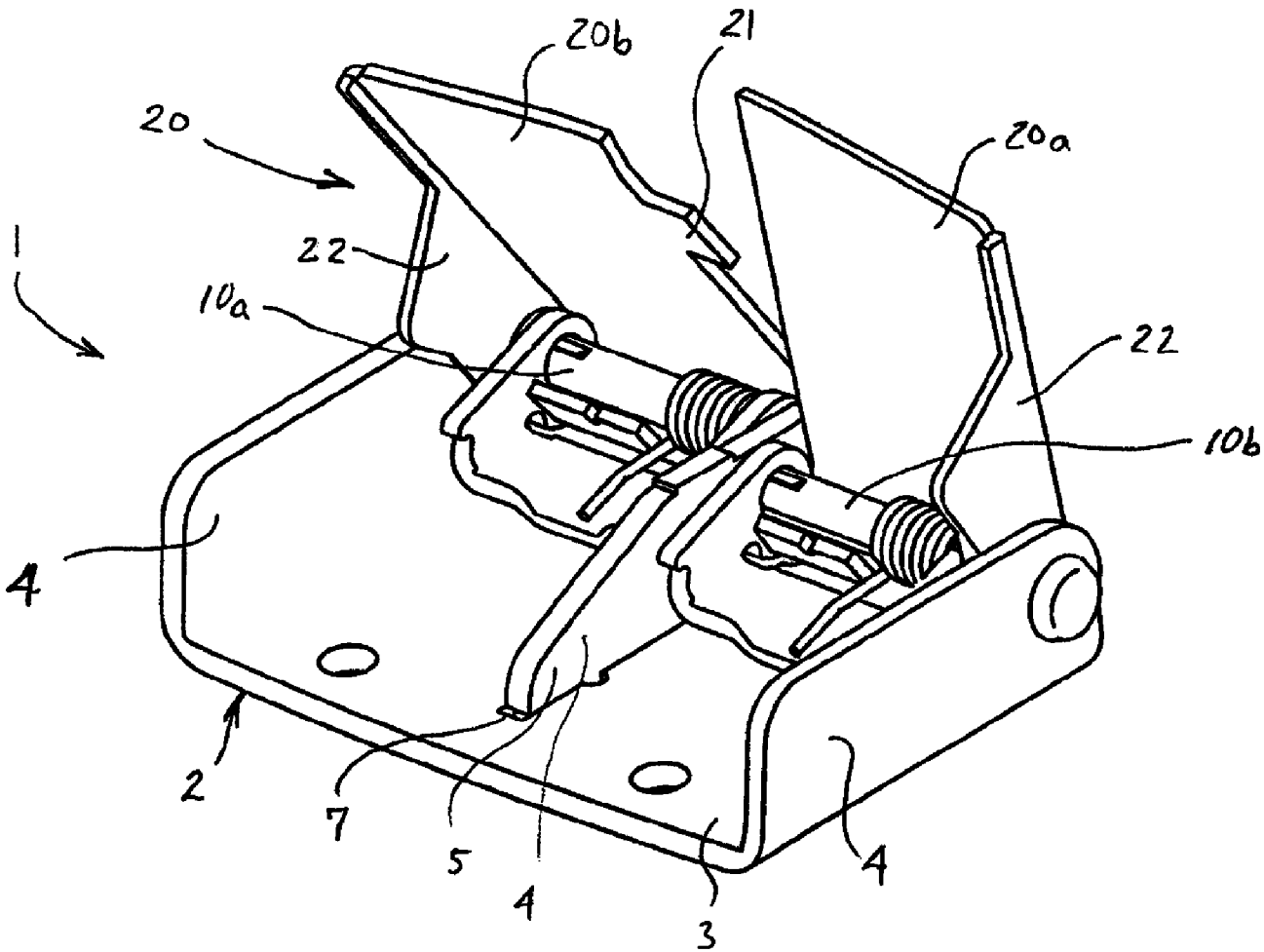
FIG. 5 is a perspective view of an alternative buckle assembly consistent with the invention but having a handle having at least two portions and staggered pivot axles.
Figure 6:
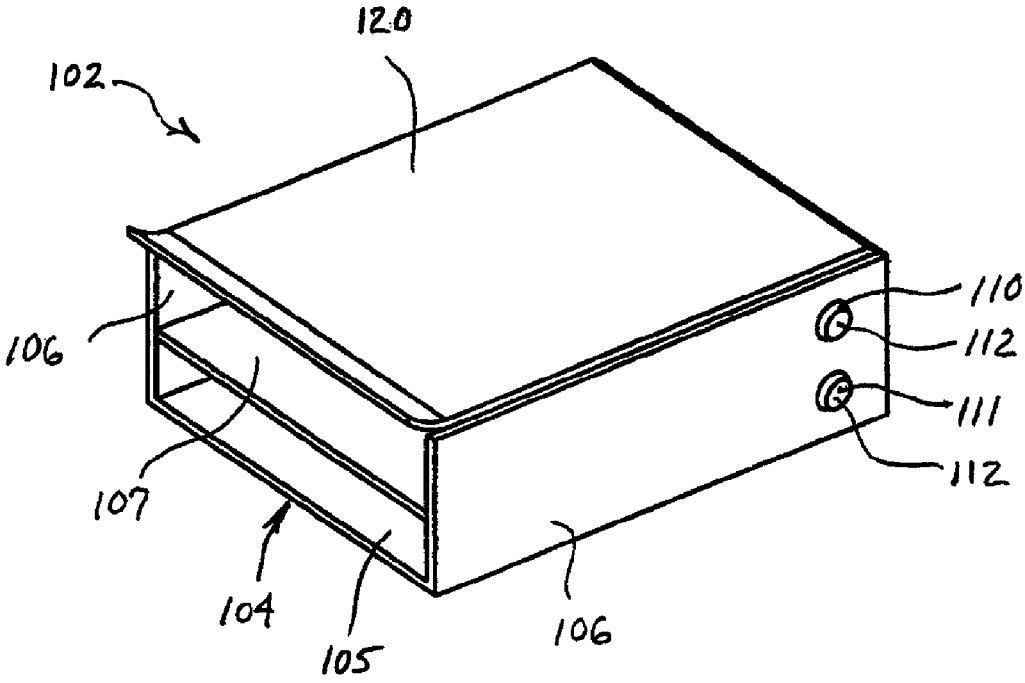
FIG. 6 is a perspective view of an alternative buckle assembly having a pair of latches arranged in spaced, parallel planes for engaging a respective pair of belt connectors in stacked relation to each other consistent with the present invention.
Figure 7:
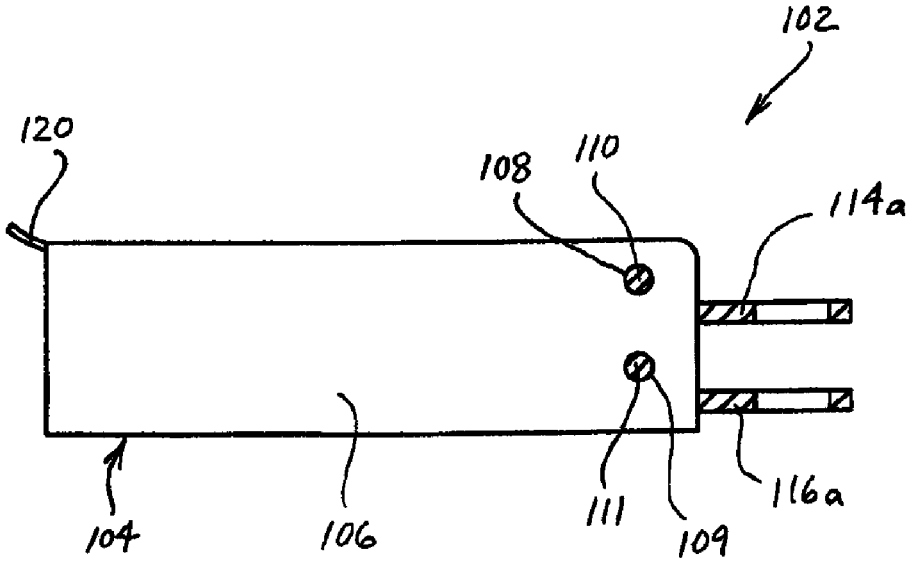
FIG. 7 is a side view of the alternative buckle assembly of FIG. 6 with a pair of belt connectors inserted and shown in cross-section.
Figure 8:
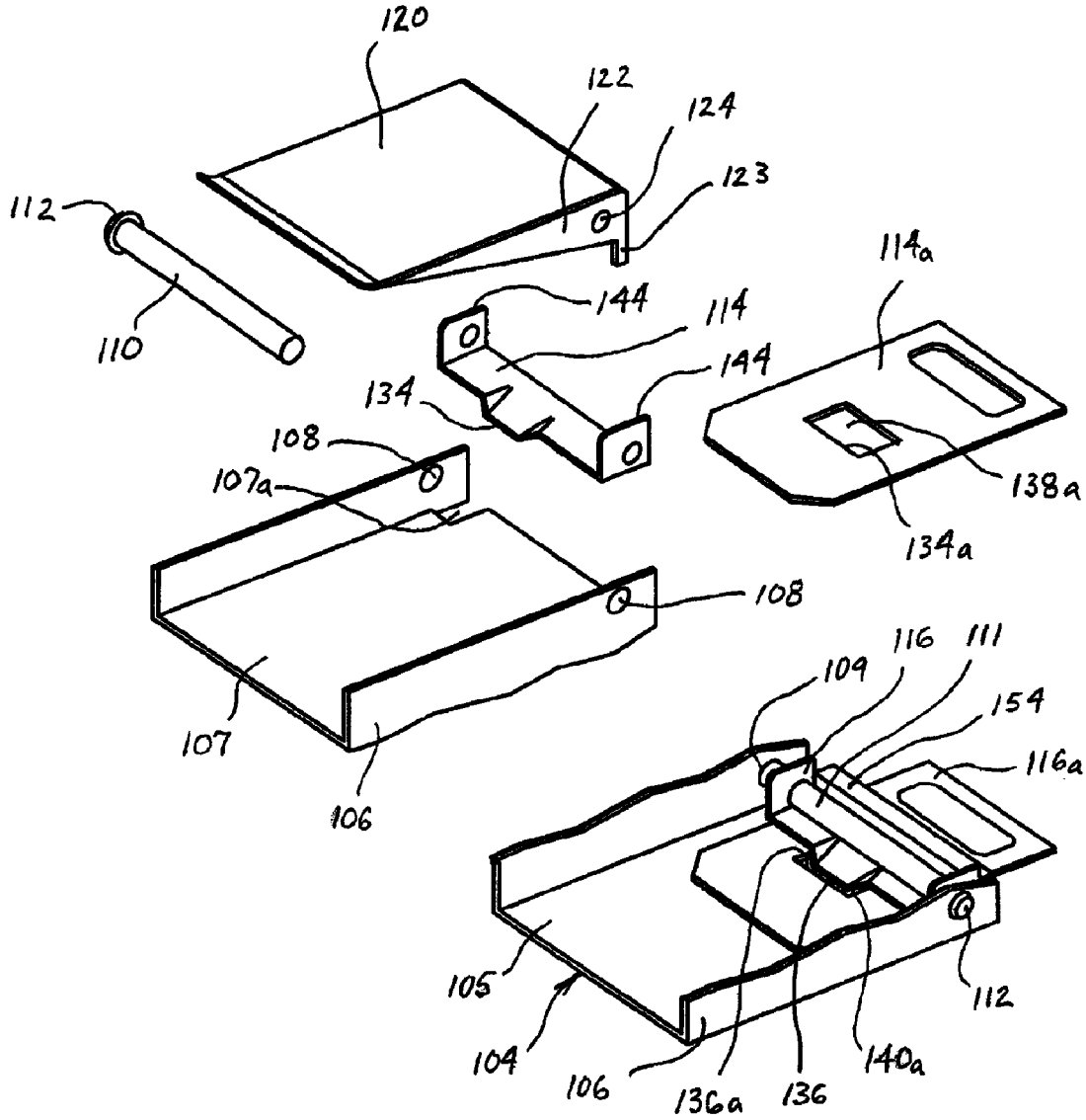
FIG. 8 is a partially exploded, perspective view of the alternative buckle assembly of FIG. 6 with the assembly separated into upper and lower sections and with the resilient members removed to better illustrate the configurations of the respective latches.
Figure 9:
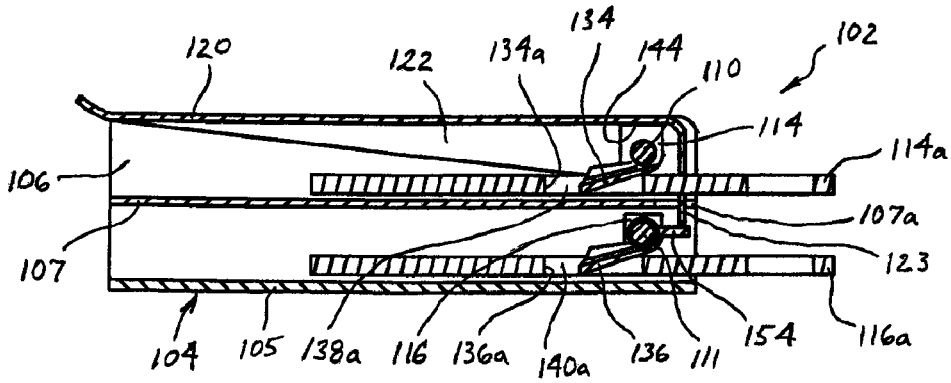
FIG. 9 is a sectioned side view of the alternative buckle assembly of FIG. 6 with the handle in a latching position.
Figure 10:
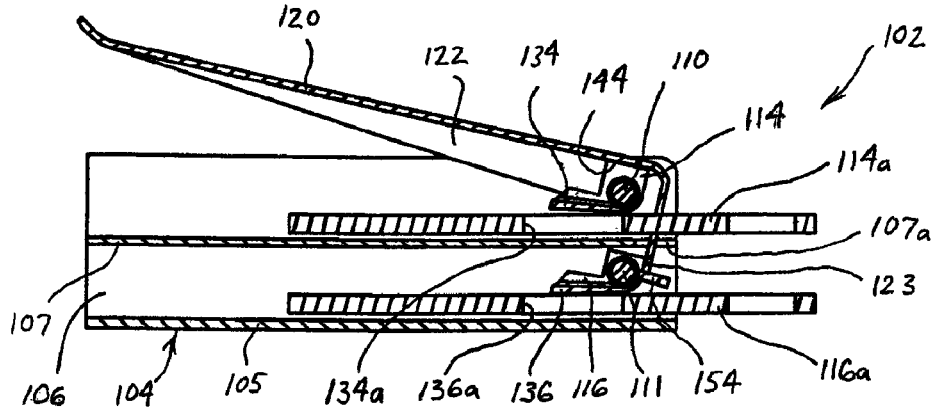
FIG. 10 is a sectioned side view of the alternative buckle assembly of FIG. 6 with the handle in a release position.

The alternative preferred embodiment shown in FIG. 5 has a handle 20' having separate portions 20'*a*, 20'*b*. This embodiment permits individual release of a selected belt connector, such as a shoulder belt connector, for instance, by moving handle portion 20'*a* to a release position, while leaving handle portion 20'*b* in a latching position. The multi-piece handle 20' also permits selective simultaneous release of all belt connectors by moving handle portion 20'*b* to a release position. This is affected by tab 21 which extends to the side of handle portion 20'*b*. Tab 21 is configured to have a portion positioned behind handle portion 20'*a*, to cause handle portion 20'*a* to be moved along with handle portion 20'*b* when handle portion 20'*b* is moved.

The embodiment in FIG. 5 is shown without resilient members to bias the handles to the latching position for ease of illustration of the pivot axles. This embodiment illustrates that each latch 14, 16 may be pivotally coupled to the buckle base by a separate pivot axle 10*a*, 10*b* respectively. The separate pivot axles 10*a*, 10*b*, can but need not share a common axis if a handle 20 is configured to have two portions.

Referring now to an alternative preferred embodiment in FIGS. 6-10, a buckle assembly 102 has a buckle base 104 which, as with the prior embodiments, may be constructed in various ways and is intended to be coupled to further components in an occupant or cargo restraint system. In this embodiment, buckle base 104 has a bottom portion 105, a parallel spaced upstanding flanges 106 and a center portion 107 extending between upstanding flanges 106. Center portion 107 has a notch 107*a* along each side at its rear edge. Flanges 106 further have a pair of aligned respective apertures 108, 109 therethrough. Aligned apertures 108 receive a pivot axle 110, while aligned apertures 109 receive a pivot axle 111, parallel to pivot axle 110. As with pivot axle 10 in the first preferred embodiment, pivot axles 110, 111 are fixed in position in engagement with apertures 108, 109 by press fitting, knurled engagement or other suitable means, and may include comparable capped ends 112 integrally formed as part of pivot axles 110, 111 or attached thereto.

In the alternative embodiment shown in FIGS. 6-10, the plurality of latches is a pair of latches 114, 116, pivotally mounted on the parallel pivot axles 110, 111, in parallel planes for receipt of respective belt connectors 114*a*, 116*a* in stacked relation to each other. Buckle assembly 102 further includes handle 120 having downward projecting parallel flanges 122 which include downward projecting tabs 123. Flanges 122 have aligned apertures 124 for pivotal mounting of handle 120 on pivot axle 110. Handle 120 is biased toward a latching position L by a resilient member which may be similar to that in the other preferred embodiments, but is not shown. Latches 114, 116 each have a pawl 134, 136 adapted to engage respective forward wall 134*a*, 136*a* of apertures 138*a*, 140*a* in belt connectors 114*a*, 116*a* when handle 120 is in the latching position L'. To establish and maintain the engagement of pawls 134, 136, each latch 114, 116 may have a resilient member similar to that in the other preferred embodiments, but not shown, to bias the respective pawl toward the latched position.

To release the belt connectors 114*a*, 116*a*, handle 120 is pivoted to an angled release position R'. When handle 120 is pivoted about pivot axle 110 toward the release position R', the upper edges 144 of the upper latch 114 engage the underside of handle 120 and cause latch 114 to pivot about pivot axle 110 along with handle 120. Because of this configuration which utilizes a relatively low lash, direct drive of upper latch 114 by the underside of handle 120, it will be appreciated that optionally handle 120 and upper latch 114 may be biased toward the latching position by use of a single resilient member that tends to bias handle 120 or latch 114 toward the latching position. Referring now to the interaction with lower latch 116, when handle 120 is moved to a release position, the downward projecting tabs 123 at the rear end of handle 120 engage a rearward projecting tab 154 of the lower latch 116, simultaneously causing latch 116 to move to a release position. In the release position, pawls 134, 136 are lifted out of engagement with respective forward walls 134*a*, 136*a* of apertures 138*a*, 140*a* in belt connectors 114*a*, 116*a*. Thus, in this release position R', belt connectors 114*a*, 116*a* are simultaneously released and permitted to be withdrawn from buckle assembly 102.

Figure 11:
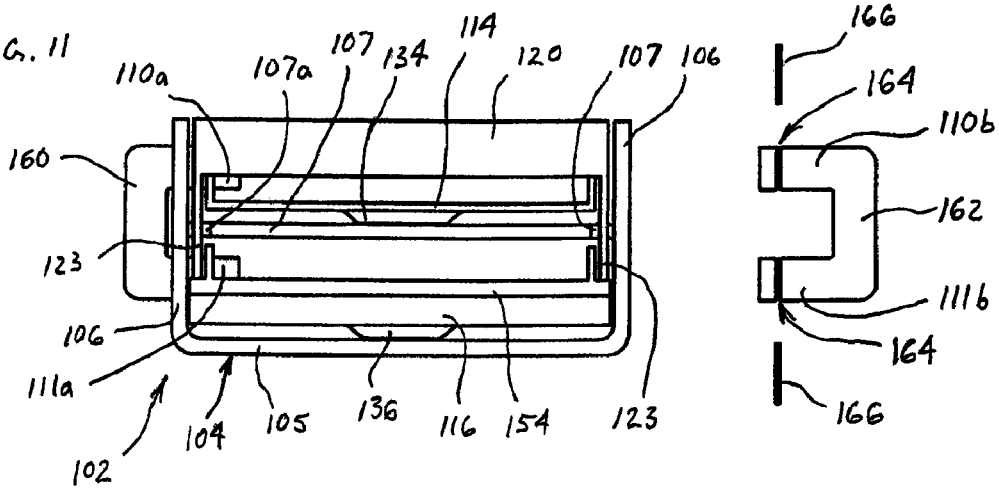
FIG. 11 is a frontal end view of the alternative buckle assembly of FIG. 6 but having alternative pivot axle structures.

Now turning to the further preferred embodiment in FIG. 11. This embodiment illustrates additional alternative ways of configuring the pivot axles. For instance, on the left side, a C-shaped portion 160 provides a pair of spaced stub shafts that serve as pivot axles 110*a*, 111*a* for the left side of buckle assembly 102. Pivot axles 110*a*, 111*a* of C-shaped portion 160 may be press fit into the apertures in upstanding flanges 106, or held in place by other suitable fasteners or means of attachment. For instance, on the right side, a further C-shaped portion 162 provides a corresponding respective pair of spaced stub shafts that serve as pivot axles 110*b*, 111*b* for the right side of buckle assembly 102, and which will be inserted through the apertures in upstanding flange 106. In this case, pivot axles 110*b*, 111*b* of C-shaped portion 162 also have grooves 164 to receive clips 166 to fasten C-shaped portion 162 to upstanding flange 106. Thus, FIG. 11 presents further examples of alternative ways of providing the pivot axles. Similarly, it will be appreciated that individual stub shaft portions (not shown) also may be used, such as via press fit, to provide the pivot axles.

In the preferred embodiments, the latches and pivot axles are preferably made of steel, aluminum, alloys, plastics or other suitable rigid materials. To reduce weight, the base plates and handles preferably are made of aluminum, but could be made of steel, alloys, plastics or other suitable rigid materials. The resilient members may be made of spring steel, such as in a coil spring, or any other suitable material and configuration to perform the biasing function of a resilient member.

It will be appreciated that a buckle assembly in accordance with the present invention may be provided in various configurations that will receive and latch at least two independent belt connectors, but still provide for simultaneous release of all belt connectors upon moving a handle to a release position. Any variety of suitable materials of construction, configurations, shapes and sizes for the components and methods of connecting the components may be utilized to meet the particular needs and requirements of an end user. It will be apparent to those skilled in the art that various modifications can be made in the design and construction of such a buckle assembly without departing from the scope or spirit of the present invention, and that the claims are not limited to the preferred embodiments illustrated.

What is claimed is:

1. A buckle assembly for attachment to a plurality of belt connectors, the buckle assembly comprising:

a buckle base having a bottom portion and spaced apart upstanding flanges at least along lateral edges of the bottom portion;

a first latching mechanism mounted between the spaced apart upstanding flanges of the bottom portion, wherein the first latching mechanism includes a first latch pawl that is movable to a first engaging position in which the first latch pawl engages a first latching abutment of a first belt connector, and wherein the first latching mechanism further includes a first biasing element urging the first latch pawl toward the first engaging position;

at least a second latching mechanism spaced apart from the first latching mechanism and mounted between the spaced apart upstanding flanges of the bottom portion, wherein the second latching mechanism includes a second latch pawl that is independently movable relative to the first latch pawl to a second engaging position in which the second latch pawl engages a second latching abutment of a second belt connector, and wherein the second latching mechanism further includes a second biasing element urging the second latch pawl toward the second engaging position; and an operating handle movable between a latch position toward the buckle base and a release position away from the buckle base, wherein the first latch pawl is engaged with the first latching abutment and the second latch pawl is engaged with the second latching abutment when the operating handle is in the latch position, and wherein the first latch pawl is disengaged from the first latching abutment and the second latch pawl is disengaged from the second latching abutment when the operating handle is moved away from the buckle base toward the release position.

2. The buckle assembly of claim 1, further comprising at least one pivot axle coupled to the buckle base, wherein at least the first latch pawl is pivotally coupled to the pivot axle.

3. The buckle assembly of claim 1, further comprising first and second pivot axles coupled to the buckle base, wherein the first latch pawl is pivotally coupled to the first pivot axle and the second latch pawl is pivotally coupled to the second pivot axle.

4. The buckle assembly of claim 1 wherein the buckle base includes at least two upstanding parallel flanges, and wherein the buckle assembly further comprises at least one pivot axle received in apertures in the upstanding flanges, wherein at least the first latch pawl is pivotally coupled to the pivot axle.

5. The buckle assembly of claim 1 wherein the buckle base includes at least three upstanding parallel flanges.

6. The buckle assembly of claim 5 wherein the buckle base receives the first belt connector between a first pair of the upstanding parallel flanges and the second belt connector between a second pair of the upstanding parallel flanges.

7. The buckle assembly of claim 5, further comprising at least one pivot axle received in apertures in the upstanding flanges, wherein at least the first latch pawl is pivotally coupled to the at least one pivot axle.

8. The buckle assembly of claim 1 wherein the operating handle is pivotally coupled to the buckle base.

9. The buckle assembly of claim 1 wherein the operating handle is pivotally coupled to the spaced apart upstanding flanges of the buckle base.

10. The buckle assembly of claim 1, further comprising at least one resilient member that biases the operating handle toward the latch position.

11. The buckle assembly of claim 1 wherein the operating handle moves the first latch pawl away from the first engaging position and the second latch pawl away from the second engaging position as the operating handle moves toward the release position.

12. The buckle assembly of claim 1 wherein the first latching abutment of the first belt connector includes a first edge portion of a first aperture in the first belt connector, and wherein the second latching abutment of the second belt connector includes a second edge portion of a second aperture in the second belt connector.

13. The buckle assembly of claim 1 wherein the operating handle rotates away from the buckle base when moving from the latch position to the release position.

14. A buckle assembly for attachment to a plurality of belt connectors, the buckle assembly comprising:

a buckle base having a bottom portion and first, second, and third spaced apart upstanding flanges;

a first latching mechanism mounted between the first and second upstanding flanges of the bottom portion, wherein the first latching mechanism includes a first latch pawl that is movable to a first engaging position in which the first latch pawl engages a first latching abutment of a first belt connector, and wherein the first latching mechanism further includes a first biasing element urging the first latch pawl toward the first engaging position;

at least a second latching mechanism spaced apart from the first latching mechanism and mounted between the first and second upstanding flanges of the bottom portion, wherein the second latching mechanism includes a second latch pawl that is independently movable relative to the first latch pawl to a second engaging position in which the second latch pawl engages a second latching abutment of a second belt connector, and wherein the second latching mechanism further includes a second biasing element urging the second latch pawl toward the second engaging position;

at least one pivot axle received in apertures in the first, second, and third upstanding flanges, wherein the at least one pivot axle is comprised of a first axle portion and a second axle portion, and wherein the first latch pawl is pivotally coupled to the first axle portion and the second latch pawl is pivotally coupled to the second axle portion; and an operating handle movable between a latch position and a release position, wherein the first latch pawl is engaged with the first latching abutment and the second latch pawl is engaged with the second latching abutment when the operating handle is in the latch position, and wherein the first latch pawl is disengaged from the first latching abutment and the second latch pawl is disengaged from the second latching abutment when the operating handle is in the release position.

15. The buckle assembly of claim 14 wherein the third upstanding flange is positioned between the first and second upstanding flanges.

16. The buckle assembly of claim 14 wherein the third upstanding flange is positioned between the first and second upstanding flanges, wherein the first latching mechanism is mounted between the first and third upstanding flanges, and the second latching mechanism is mounted between the third and second upstanding flanges.

17. The buckle assembly of claim 14, further comprising at least one resilient member that biases the operating handle toward the latch position.

18. A buckle assembly for attachment to a plurality of belt connectors, the buckle assembly comprising:

a buckle base;

a first latching mechanism mounted to the buckle base, wherein the first latching mechanism includes a first latch pawl that is movable to a first engaging position in which the first latch pawl engages a first edge portion of a first aperture in a first belt connector, and wherein the first latching mechanism further includes a first biasing element urging the first latch pawl toward the first engaging position;

a second latching mechanism spaced apart from the first latching mechanism and mounted to the buckle base, wherein the second latching mechanism includes a second latch pawl that is independently movable relative to the first latch pawl to a second engaging position in which the second latch pawl engages a second edge portion of a second aperture in a second belt connector, and wherein the second latching mechanism further includes a second biasing element urging the second latch pawl toward the second engaging position; and an operating handle movable in a direction away from the buckle base to a release position in which the first latch pawl is disengaged from the first edge portion of the first aperture and the second latch pawl is disengaged from the second edge portion of the second aperture.

19. The buckle assembly of claim 18 wherein the operating handle is pivotally movable to the release position.

20. The buckle assembly of claim 18 wherein the operating handle is pivotally coupled to the buckle base.

21. The buckle assembly of claim 18 wherein the operating handle moves the first latch pawl away from the first engaging position and the second latch pawl away from the second engaging position as the operating handle pivots toward the release position.

22. The buckle assembly of claim 18 wherein the buckle base includes first and second spaced apart upstanding flanges, wherein the first and second latching mechanisms are mounted between the first and second upstanding flanges, and wherein the operating handle is pivotally coupled to the first and second upstanding flanges.

23. The buckle assembly of claim 18 wherein the first latching mechanism includes a first pivot axle and the second latching mechanism includes a second pivot axle, and wherein the first latch pawl is operably coupled to the first pivot axle and the second latch pawl is operably coupled to the second pivot axle.

24. The buckle assembly of claim 18 wherein the buckle base includes first and second spaced apart upstanding flanges, wherein the buckle assembly further comprises a pivot axle extending between the first and second upstanding flanges, wherein first and second latching mechanisms are pivotally mounted to the pivot axle between the first and second upstanding flanges, and wherein the operating handle is pivotally mounted to the pivot axle.

25. A buckle assembly for attachment to a plurality of belt connectors, the buckle assembly comprising:

a buckle base having first and second spaced apart upstanding flanges;

a first latching mechanism mounted to the buckle base, wherein the first latching mechanism includes a first latch pawl that is movable to a first engaging position in which the first latch pawl engages a first edge portion of a first aperture in a first belt connector, and wherein the first latching mechanism further includes a first biasing element urging the first latch pawl toward the first engaging position;

a second latching mechanism spaced apart from the first latching mechanism and mounted to the buckle base, wherein the second latching mechanism includes a second latch pawl that is independently movable relative to the first latch pawl to a second engaging position in which the second latch pawl engages a second edge portion of a second aperture in a second belt connector, and wherein the second latching mechanism further includes a second biasing element urging the second latch pawl toward the second engaging position;

an operating handle movable to a release position in which the first latch pawl is disengaged from the first edge portion of the first aperture and the second latch pawl is disengaged from the second edge portion of the second aperture;

a pivot axle extending between the first and second upstanding flanges, wherein first and second latching mechanisms are pivotally mounted to the pivot axle between the first and second upstanding flanges, and wherein the operating handle is pivotally mounted to the pivot axle; and a third upstanding flange positioned between the first and second upstanding flanges and between the first and second latching mechanisms, wherein the pivot axle extends through an aperture in the third upstanding flange.

26. The buckle assembly of claim 25 wherein the operating handle is pivotally coupled to the buckle base.

27. The buckle assembly of claim 25 wherein the operating handle is pivotally coupled to the first and second spaced apart upstanding flanges of the buckle base.

* * * * *